US006499687B2

(12) United States Patent
Bryant

(10) Patent No.: US 6,499,687 B2
(45) Date of Patent: Dec. 31, 2002

(54) DRIP LINE IRRIGATION TUBING DISPENSER

(76) Inventor: Keith R. Bryant, P.O. Box 1325, Shingle Springs, CA (US) 95682

( * ) Notice: Subject to any disclaimer, the term of this patent is extended or adjusted under 35 U.S.C. 154(b) by 0 days.

(21) Appl. No.: 09/803,547

(22) Filed: Mar. 12, 2001

(65) Prior Publication Data

US 2002/0125362 A1 Sep. 12, 2002

(51) Int. Cl.[7] ..... B65H 75/20; B65H 75/40

(52) U.S. Cl. ..... 242/395; 242/406; 242/563.2; 242/597.7; 242/407

(58) Field of Search ..... 242/395, 395.1, 242/397.5, 401, 406, 563.2, 597.7, 129, 407, 604.1

(56) References Cited

U.S. PATENT DOCUMENTS

| | | | | | |
|---|---|---|---|---|---|
| 619,278 | A | * | 2/1899 | Cashin | 242/597.7 |
| 1,281,802 | A | * | 10/1918 | Madill | 242/597.7 |
| 1,675,429 | A | * | 7/1928 | Schnee | 242/597.7 |
| 1,688,582 | A | * | 10/1928 | Heinrich | 242/597.7 |
| 1,839,321 | A | * | 1/1932 | Kent | 242/597.7 |
| 2,197,767 | A | * | 4/1940 | Neale | 242/395 |
| 2,598,572 | A | * | 5/1952 | Losinski et al. | 242/597.7 |
| 2,990,135 | A | * | 6/1961 | Croteau et al. | 242/597.7 |
| 3,199,805 | A | * | 8/1965 | Kohn et al. | 242/597.7 |
| 4,934,618 | A | * | 6/1990 | Guignard et al. | 242/406 |
| 5,794,883 | A | * | 8/1998 | MacEwen | 242/563.2 |
| 5,915,641 | A | * | 6/1999 | Barberg | 242/395.1 |
| 2001/0035473 | A1 | * | 11/2001 | Patton | 242/406 |

FOREIGN PATENT DOCUMENTS

| | | | | |
|---|---|---|---|---|
| EP | 0189148 A2 | * | 1/1986 | 242/597.7 |
| EP | 0403671 A1 | * | 6/1989 | 242/406 |
| JP | 1-214591 | * | 8/1989 | 242/397.5 |

* cited by examiner

*Primary Examiner*—John M. Jillions
(74) *Attorney, Agent, or Firm*—Mark C. Jacobs

(57) ABSTRACT

A device for the dispensing of drip system tubing for commercial installers of such irrigation systems. The device has a lower base upon which is centrally disposed a spaced bearing housing with a bearing therein for rotation of an upper base. The upper base has a reel optionally removably mounted thereto, for receipt of a coil of drip system line. The device may include grab handles for carrying it from location to location. It may also include a handle for aiding in the rotation of the upper base relative to the lower base for the dispensing of the drip line tubing. An optional counter for measuring the amount of drip line dispensed may also be included.

18 Claims, 5 Drawing Sheets

DRIP LINE IRRIGATION TUBING DISPENSER

FIELD OF THE INVENTION

This invention relates to a device for the distribution of irrigation drip line for use below ground or above ground for plant irrigation systems.

BACKGROUND OF THE INVENTION

Drip systems today are becoming more and more popular due to increased costs of residential water and because drip irrigation systems deliver water directly to the individual plants and not just to zones or areas where plants are growing. By direct delivery to individual plants water costs can be reduced.

The coils of drip tubing for commercial installation come in 500 to 1000 foot lengths. Like any other coiled product, if not placed on a reel, the drip line product is subject to kinking and entanglement. Plus, the weight of such large (500/1000 foot) reels, or even 100 foot reels for home use is more than the average person cares to relocate a plurality of times. Therefore there has developed a need for an easy to use low-cost drip tubing dispenser, especially for commercial users, that is members of the installment industry.

Accordingly, it is a first object to provide a dispenser, preferably with interchangeable reels for various lengths of tubing.

It is a second object to provide a drip line dispenser that is easy to carry.

It is a third object to provide a drip line dispenser that permits controllable metering of drip line tubing.

It is a fourth object to provide a drip line dispenser that is low in cost.

A fifth object is to provide a drip tubing dispensing device that can be operated by one worker.

Thus, there is to be described herein a drip tubing dispenser having a lower base upon which is disposed a bearing housing that supports a rotatable upper base. The upper base has a fixed or removably interchangeable reel thereon for receiving the drip line coil. The reel includes a handle mounted on the top thereof for easy one person metering. A counter can also be employed.

Other objects of the invention will in part be obvious and will in part appear hereinafter.

The invention accordingly comprises the device possessing the features, properties and the relation of components which are exemplified in the following detailed disclosure and the scope of the application of which will be indicated in the appended claims.

For a fuller understanding of the nature and objects of the invention, reference should be made to the following detailed description, taken in conjunction with the accompanying drawings.

SUMMARY OF THE INVENTION

A horizontal oriented dispenser for drip line tubing which has a fixed lower base with an upstanding bearing housing mounted thereon, and an upper base capable of rotation with respect to the lower base, is also mounted to the bearing housing. A reel for holding a coil of drip line tubing is disposed on the upper base.

Optional accessories include a handle mounted on the top of the reel to aide in rotation and a pair of fixed grab bars disposed on the lower or fixed base for carrying the device. A metering means may also be included.

DESCRIPTION OF THE PREFERRED EMBODIMENT

Figure 1:
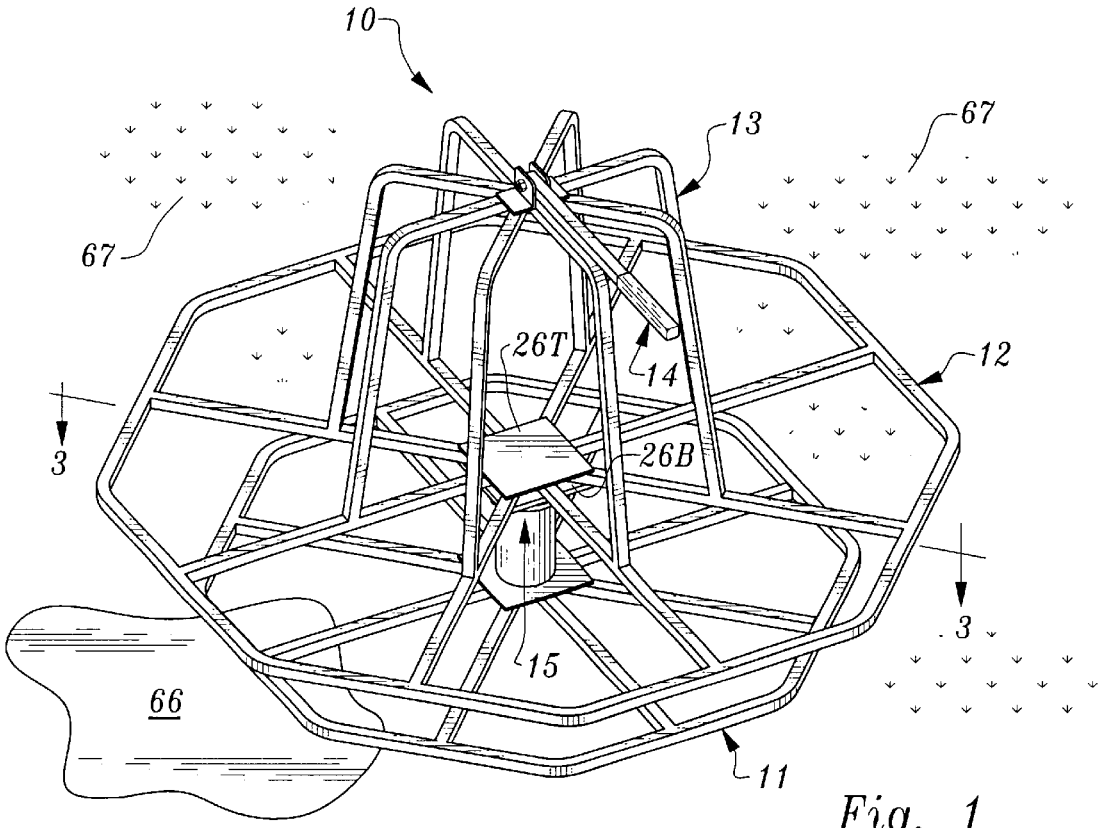
FIG. 1 is a top perspective view of the first embodiment of the dispenser of this invention.

In FIG. 1 the device 10 of this invention is seen sitting in a typical working environment grass 67. More often than not, the device will be employed while sitting only in raw dirt such as 66.

Device 10, comprises five (5) main sections, which are the lower base 11, upper base 12, reel 13, handle portion 14, and the rotation means 15 all of which will be discussed.

Figure 2:
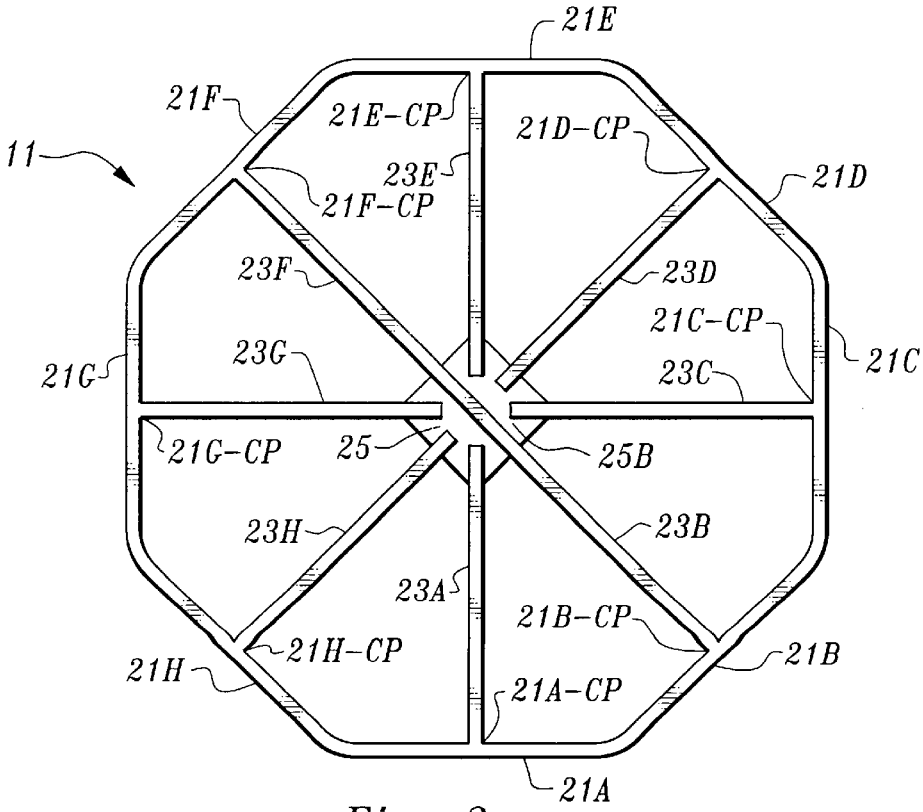
FIG. 2 is a bottom plan view of the first portion of this invention.

In FIG. 2 there is seen the first portion of the first embodiment; namely, the lower base 11. Base 11 in this embodiment is generally octagonal and has eight outer base pieces of square tubing sections 21A–21H inclusive connected end to end. Disposed inwardly from the center point of each base section-denoted CP but only at two locations for ease of understanding, are a series of eight elongated square tubing sections, usually ½" in cross section. These radii 23A–23H are all equal in length and extend from the various 21 outer base pieces to a center plate 25. The radii are each welded or braised to their respective base sections and to the center plate 25. All of the base pieces are connected in like manner, i.e., by welding or braising, all in the same horizontal plane, to the underside of the center plate 25, designated 25B as being the bottom of the center plate 25. Thus the center plate 25 is disposed above the radii when in an in use position, with all the radii and the outer base pieces being disposed at the ground level in a horizontal disposition.

Figure 4:
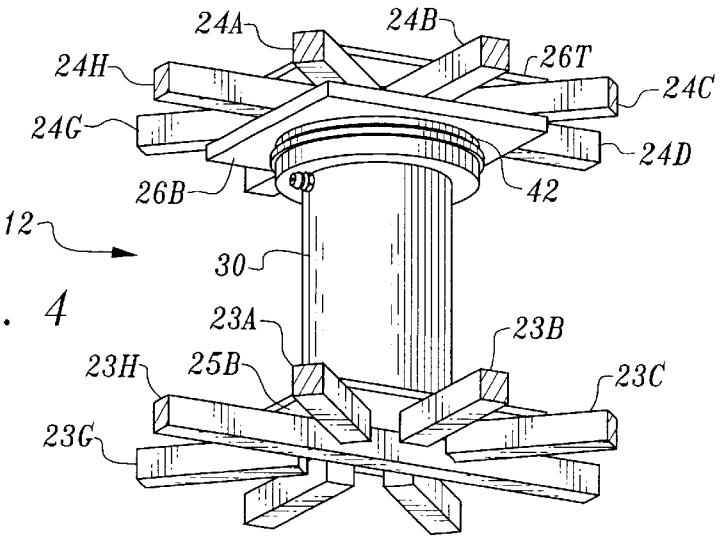
FIG. 4 is a close-up diagrammatic view of part of this invention.
Figure 3:
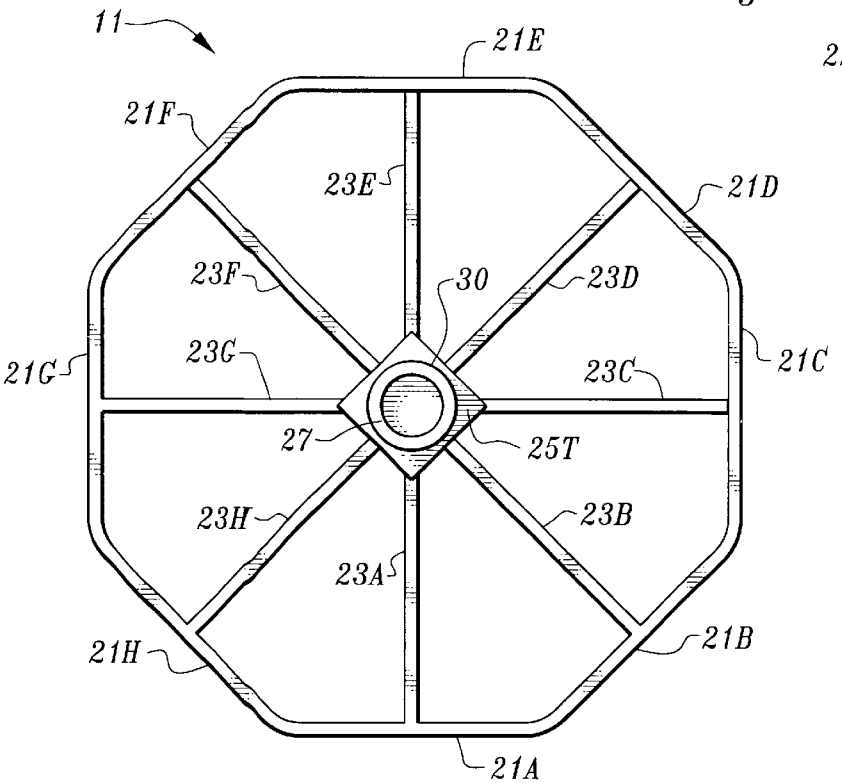
FIG. 3 is a top plan view taken along the line 3—3 of FIG. 1, showing the top surface of the lower base.

In FIG. 3, the top plan view of the lower base, the center plate's top surface, 25T is seen overlying the upper face of the square tubing radii 23A–23H. Disposed on the center plate's face 25T, is bearing housing 27 which is one of the components of the rotation means 15 shown in FIG. 1. See also FIG. 8. FIG. 4 is a diagrammatic view showing part of the lower base; namely, base sections 24A, 24B, 24C, 24D, 24G and 24H, with radius 24A extending inwardly from base section 23A. Disposed upon center platform 25T is bearing housing 27, more about which will be recited infra. A part of upper base 12—shown in its entirety in FIG. 5 and fully discussed infra—is seen welded or otherwise attached to the bearing cylinder 27. For ease and simplicity only radii 23B, 23C, 23G and 23H are depicted. For additional parts relationship understanding, see FIG. 8.

Just as with the lower base, here too for the upper base, the radii 26A–26H are welded, bolted or otherwise attached at equiangular separations between two upper center plates 26T and 26B. Two plates, 26T and 26B are used for both strength and appearance, since there is no issue of the base needing to maintain a level disposition, since it is spaced up from the ground.

Figure 5:
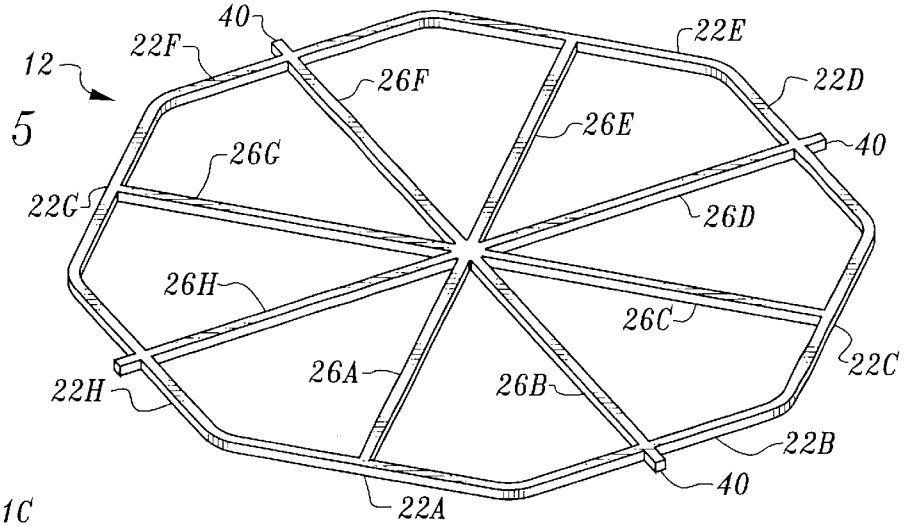
FIG. 5 is a perspective view of the upper base portion of this invention.

In FIG. 5 we see the upper base 12 similarly configured to lower base 11, though it need not be. Upper base 12 is also constructed of preferably square ½" tubing and may be of the same or different diameter as the lower base. In FIG. 1, the upper base is of greater cross section than the lower base. Four optional grab bars 40 for manually rotating the upper base are shown attached to the upper base at different locations around the periphery. These grab bars 40 can also be used to stop the rotation of the upper base should the user snatch onto one of them during a period of rotation.

Figure 8:
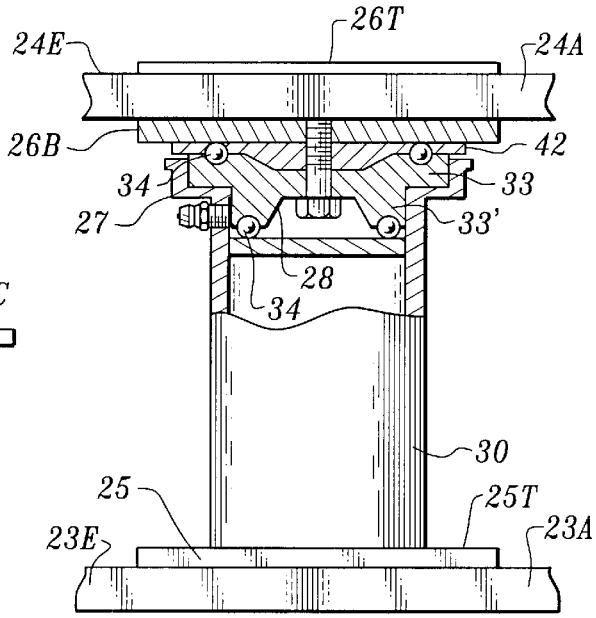
FIG. 8 is a partial closeup side elevational view of the apparatus of this invention.

Whereas in FIG. 8, the top plate 26T and bottom plate 26B are disposed over and beneath the radii respectively. Here in FIG. 5, center plates 26T and B are not separately employed. In this variant, the welding of all of the proximal ends of the radii together negates the need for the plates. The distal ends of the radii are welded or otherwise attached to the respective center points of each base section 22A–H. Contrast this to the spaced inner termini as per FIG. 8.

Figure 6:
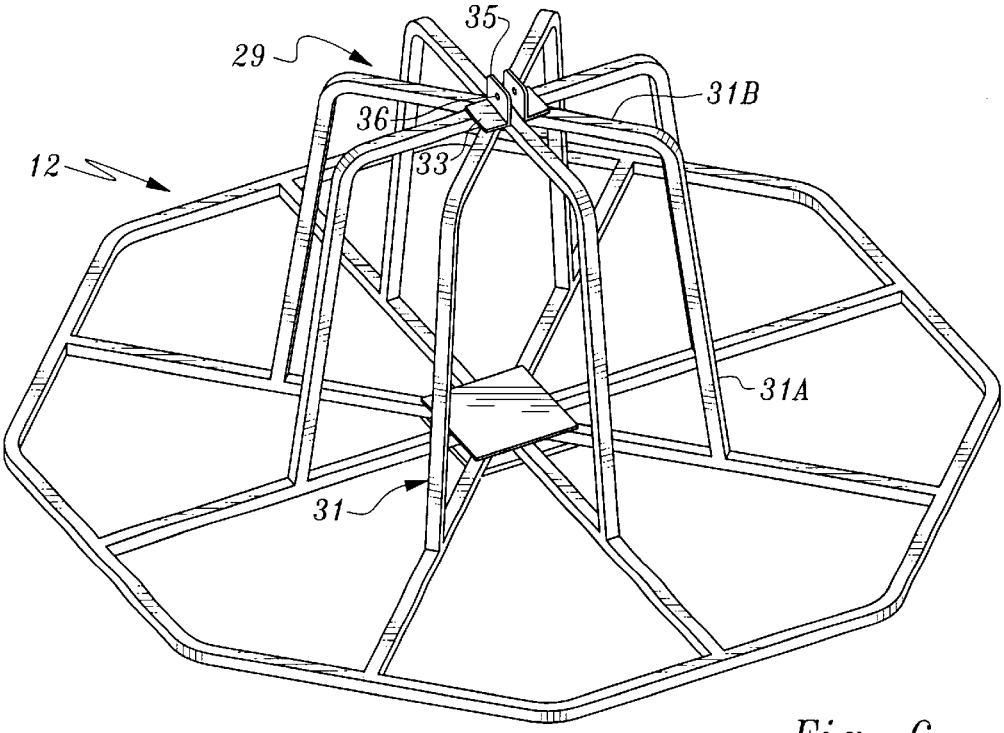
FIG. 6 is an unassembled perspective view of the reel portion of this invention.
Figure 7:
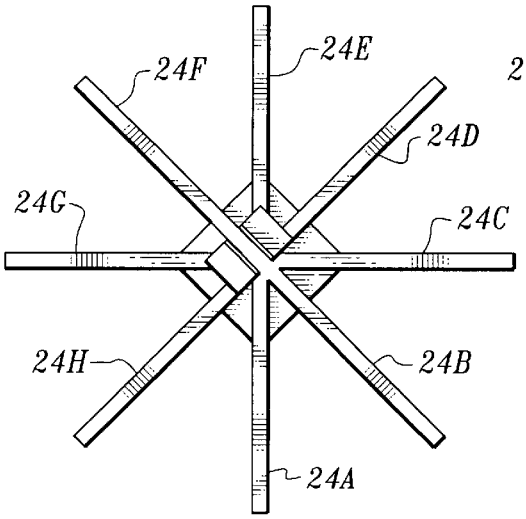
FIG. 7 is a top plan view of the reel portion of this invention.

In FIG. 6 the reel upon which the tubing is placed is seen in perspective, while in FIG. 7 parts of the reel 29 upon which, the 100, 500 or 1,000 foot coil of drip line tubing is placed are seen in top plan. Each leg of the reel 31 is formed in the shape of an inverted L and has a vertical portion positioned at an angle slightly greater than 90 degrees relative to the horizontal portion 31B to which 31A is attached at a preferably slightly rounded interface.

Each of these inverted Ls 31 is evenly spaced apart from the adjacent ones. Eight are shown here, though as few as four at 90 degrees or three at 120 degrees apart may be employed, while six or eight reel sections 31 provides a more stable reel.

All of the reel sections as shown in FIG. 6 are connected at their distal ends greater than 90 degrees to the upper base as shown here and in FIG. 1. The proximal ends of all of the inverted L sections are welded to each other and to the optional hub 33 upon which is a handle means mounted as by welding.

Figure 9:
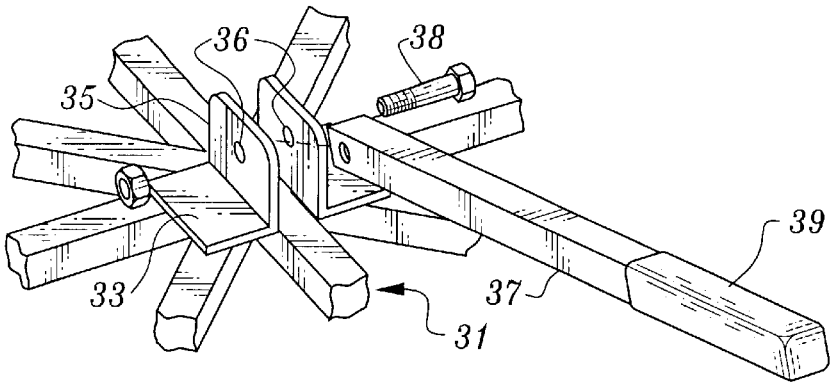
FIG. 9 is a perspective view of a handle portion for rotation of the reel.

Reference is also made to FIG. 9 which depicts a portion of the structure shown in FIG. 6. The handle means includes a pair of spaced flanges 35, each of which has a central throughbore 36. Both bores 36 are aligned to receive a pin 38 shown in FIG. 9 to pivotally mount handle 37 thereon. An optional rubber cover 39 similar to a bicycle handle bar grip may be disposed upon handle 37. Handle 37 is used to quickly turn the reel 29.

In FIG. 7, which is a top plan view of the reel portion of this invention, only the spaced flanges for the handle and not the actual handle are seen for clarity. Each of the segment radii has been designated one of 24A–24H. While 8 segments are shown, due to the fact that an octagon is an easy configuration to assemble, 6 or 10 segments are also envisioned to be within the scope of the invention.

The discussion now turns to FIG. 8 wherein bearing housing 27 is shown in cutaway, with the balance of the view as an elevational view, to permit viewing of the bearing 28 therein. Note that only two of the radii of both the upper radii, 24A and 24E and the 23A and 23E of the lower base are shown in FIG. 8. Both center plates 26, namely 26B and 26T as shown in FIG. 1 are shown here as well.

In FIG. 8, lower base radii are seen spaced slightly apart, but in a welded position to the lower base plate 25. Disposed on the upper surface thereof, 25T is a cylindrical tube 30 of an elevation that can vary as may be desired, but with an elevation of four [4] inches providing good results. This tube 30 is welded or otherwise attached to the bearing housing 27 at its upper end and the top surface 25T of the lower base plate on its lower end. The housing is a cup-like segment having an acute side wall, and a flat bottom and is open at the top.

Disposed within the bearing housing 27 are a pair of hubs 33 disposed over a smaller hub 33', each having a plurality of ball bearings 34 therein. Such multi bearing hubs are well known in the art and are found in moving casters. The balls of the larger upper rotate against the surface of an optional galvanized cover plate 42, while the lower set of bearings rotate on the interior bottom wall of the housing 27.

A bolt or rivet holds the two hubs together for rotation relative to each other.

Cover plate 42 is welded or otherwise attached on one face to the bearing housing to close it off, and is attached in like manner on its other face to the upper base's bottom plate 26B.

It can be seen that the bottom plate 26B may also be employed directly to seal off the bearing housing, if so desired.

As can be seen here in FIG. 8, a sandwich is formed between the two top plates 25T and 25B with the series of radii welded between them. The slight space shown between radii 24A and 24E, allows for adequate heat expansion.

Figure 10:
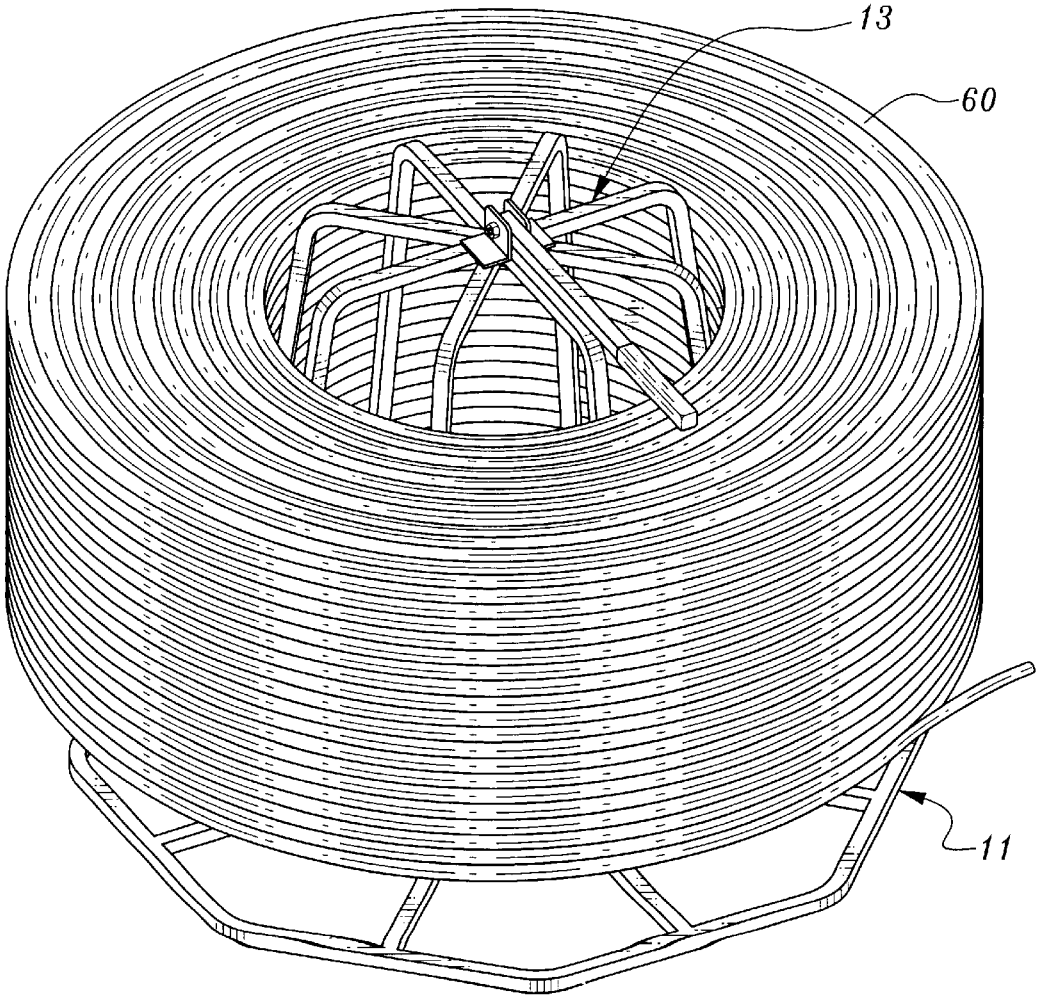
FIG. 10 is a perspective view of the device of this invention ready for use.

FIG. 10 is a perspective view showing a conventional coil 60 of drip tubing disposed upon the reel 13 and resting upon the upper base 11. Only lower base 11 is partially visible.

Figure 11:
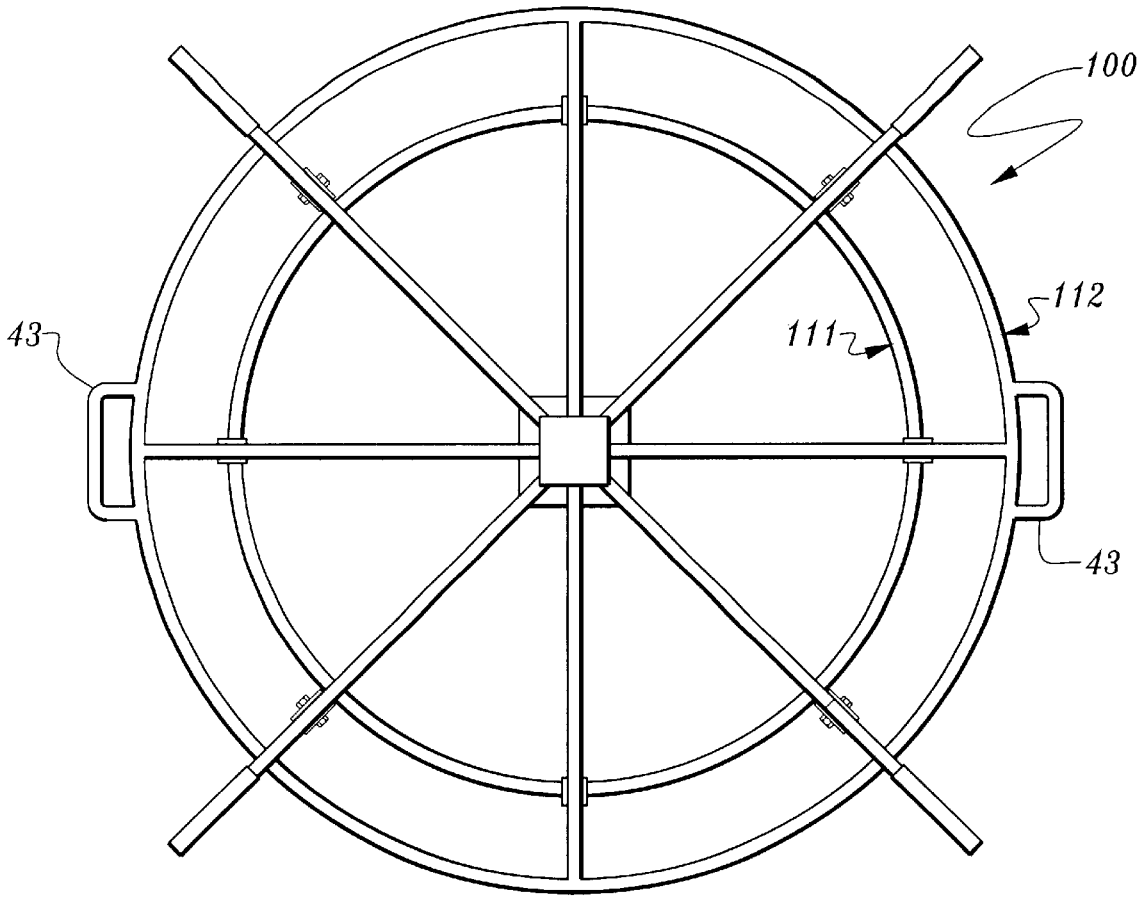
FIG. 11 depicts a variant for the upper base configuration.

In FIG. 11 an alternate configuration for the device is seen and designated 100. In this alternate version, there is a lower base 111 that is round instead of octagonal and an upper base 112 that is also round. Optional carry handles 43 spaced 180 degrees apart are seen. All other elements are the same as in FIG. 1 and need not be discussed further.

Figure 12:
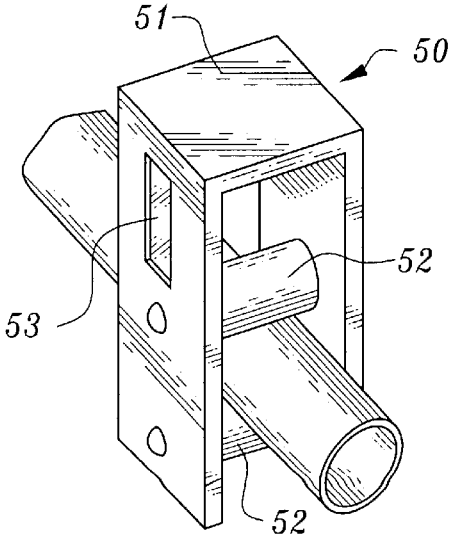
FIG. 12 is a perspective view of a counter means employable as part of this invention.

In FIG. 12 an optional counter mechanism of a conventional construction is shown, and is designated 50. The counter 50 includes a housing 51 which can be attached as by welding to device 10. The counter mechanism includes a pair of spaced rollers 52 at least on which is mechanically connected to a gear system not seen, which gear system is also connected to digital read out 53. As the tubing 60 is pulled through the two spaced rollers, the tubing frictionally engages the rollers such that they rotate to thereby move the gear connected counter readout to tell how much tubing has moved through the rollers. Such counter mechanisms are well known for the measurement of wire.

It is seen that I have devised a horizontally oriented dispenser for drip line tubing. This horizontal dispenser has a reel that holds a coil of drip tubing and which coil is easily placed on and off such a reel. By providing grab bars on the upper base, the unit can be easily loaded and unloaded from a vehicle, as needed, even by one person.

While the reels contemplated for this device are intended to be sized for a specific length of tubing such as 500 or 1,000 feet linearly, for commercial purposes, it is also within the scope of the invention to employ interchangeable replaceable reels each sized to accommodate a specific length of coil of tubing.

Figure 13:
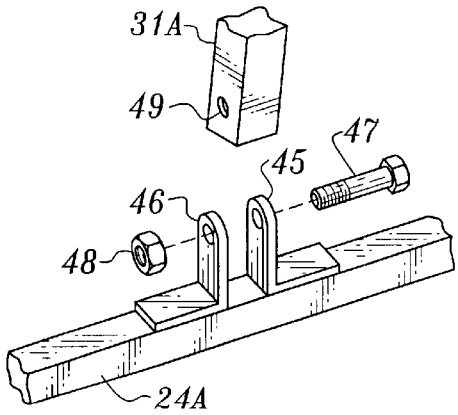
FIG. 13 is a diagrammatic view that illustrates the attachment of an interchangeable reel.

Reference is thus made to FIG. 13 which depicts such a construction diagrammaticaly Here reel member 31A,—the only one partially shown since all reel member 31A–H would be mounted in like manner,—is instead of being welded in place is merely bolted into its location. Here, a pair of spaced L flanges 45 that are positioned in an opposed spaced position, with the spacing just equal to the size of the square tubing employed in the reel are disposed upon the top surface of each upper base radius such as 24A. Each flange member has a bolt hole 46 for receiving bolt 47 when such bolt is placed through bolt hole 46 in the flange 45 and through bolt hole 49 in the respective reel arm. Bolt 47 is retained by the tightening of nut 48.

Rotation of the handle 37 allows a large amount of tubing to be dispensed quickly, and if necessary to be wound back should excess have been unwound over the amount needed.

The end of the tubing coil 60 can also be tied on to a grab bar to ensure maintenance of the coil during periods of transportation both in the field and in a vehicle.

Thus the upper base rotates relative to the lower base due to the presence of the bearing in the bearing housing. A person pulls on the end of the coil 60 of drip line to dispense the needed, amount. The larger lower base stays in place as the drip line uncoils.

To rewind, just counter-rotate the handle.

While the device of this invention is made of steel and/or other metals, and is assembled by welding or brazing, no reason is seen why this device cannot be made of a strong plastic just as easily, or even a combination of plastic and metal.

The grab bars may have a rubber coating or a rubber overlay thereon, as may the handle for more convenient use in cold weather.

It is also to be seen that while the intent of this invention is to serve as an device to dispense drip irrigation line, there may be instances where extremely long lengths of garden hose need be dispensed as well. No reason is seen why this device would not serve that purpose as well.

Since certain charges may be made in the above apparatus without departing from the scope of the invention herein involved, it is intended that all matter contained in the above description and shown in the accompanying drawings shall be interpreted as illustrative and not in a limiting sense.

I claim:

1. A device for the dispensing of drip system tubing from a reel which device comprises:

(a) a lower base of interconnected members, horizontally disposed, and having a bearing housing centrally disposed, mounted spaced upwardly from said lower base, (b) an upper base spaced from the lower base, mounted to the bearing housing for rotation relative to the lower base, (c) a reel mounted on the upper base, said reel formed of a plurality of evenly spaced inverted L-shaped members, the angle between the vertical portion and the horizontal portion of each inverted L being at least about 90 degrees and the angle between each vertical portion and its mounting to the upper base is also at, an at least 90 degree angle wherein the lower and upper bases are each octagonal, and each comprises a series of end to end interconnected base section members, each of which has a radius disposed inwardly from the center point of the base section member to at least one center plate which plate is horizontally disposed.

2. The device of claim 1 further including grab bars disposed outwardly from the upper base.

3. The device of claim 1 further including a handle means, said handle means being a pair of spaced opposed flanges having a pivotally mounted handle pinned to said flanges.

4. The device of claim 1 wherein a metering means is mounted to the upper base.

5. The device of claim 1 further including both a pair of 180 degree spaced grab bars mounted to the upper base and extending outwardly therefrom; and, a handle pivotally mounted on the tip of the reel for rotating the reel and upper base relative to the lower base.

6. The device of claim 1 wherein the reel is releasably mounted to the upper base for interchangeability of reels.

7. The device of claim 1 wherein the two angles of at least 90 degrees are substantially equal to 90 degrees.

8. The device of claim 1 wherein the two angles of at least 90 degrees are the same angle of greater than 90 degrees.

9. The device of claim 1 wherein, said lower base is of a lesser diameter than the upper base.

10. A device for the dispensing of drip system tubing from a reel which device comprises:

(a) a lower base of interconnected members, horizontally disposed, and having a bearing housing centrally disposed, mounted spaced upwardly from said lower base, (b) an upper base spaced from the lower base, mounted to the bearing housing for rotation relative to the lower base, (c) a reel mounted on the upper base, said reel formed of a plurality of evenly spaced inverted L-shaped members, the angle between the vertical portion and the horizontal portion of each inverted L being at least about 90 degrees and the angle between each vertical portion and its mounting to the upper base is also at, an at least 90 degree angle, and wherein each of said upper and lower bases comprises a series of end to end interconnected base section members, each of which has a radius disposed inwardly from the center point of the base section member to at least one center plate which plate is horizontally disposed, and said lower base is of a lesser diameter than the upper base.

11. The device of claim 10 further including grab bars disposed outwardly from the upper base.

12. The device of claim 10 further including a handle means, said handle means being a pair of spaced opposed flanges having a pivotally mounted handle pinned to said flanges.

13. The device of claim 10 wherein a metering means is mounted to the upper base.

14. The device of claim 1 further including both a pair of 180 degree spaced grab bars mounted to the upper base and extending outwardly therefrom; and, a handle pivotally mounted on the tip of the reel for rotating the reel and upper base relative to the lower base.

15. The device of claim 10 wherein the reel is releasably mounted to the upper base for interchangeability of reels.

16. The device of claim 10 wherein the two angles of at least 90 degrees are substantially equal to 90 degrees.

17. The device of claim 10 wherein the two angles of at least 90 degrees are the same angle of greater than 90 degrees.

18. The device of claim 10 wherein, said lower base is of a lesser diameter than the upper base.

* * * * *